US005617976A

United States Patent [19]

Gueret

[11] Patent Number: 5,617,976

[45] Date of Patent: Apr. 8, 1997

[54] DISPENSER OF LIQUID OR PASTY PRODUCT WHICH CAN BE USED ESPECIALLY IN COSMETICS

[75] Inventor: Jean-Louis Gueret, Paris, France

[73] Assignee: L'Oreal, Paris, France

[21] Appl. No.: 619,219

[22] Filed: Mar. 21, 1996

[30] Foreign Application Priority Data

Mar. 21, 1995 [FR] France ..... 95 03256

[51] Int. Cl.[6] ..... B67D 5/40

[52] U.S. Cl. ..... 222/380; 222/494; 222/553

[58] Field of Search ..... 222/95, 105, 207, 222/211, 214, 321.2, 321.7, 491, 492, 494, 383.1, 380, 548, 553

[56] References Cited

U.S. PATENT DOCUMENTS

| | | | |
|---|---|---|---|
| 2,815,890 | 12/1957 | Cooprider et al. . | |
| 2,853,210 | 9/1958 | Stewart et al. . | |
| 3,102,489 | 9/1963 | Corsette et al. . | |
| 4,402,432 | 9/1983 | Corsette . | |
| 4,694,977 | 9/1987 | Graf et al. . | |
| 5,100,027 | 3/1992 | Gueret . | |
| 5,271,432 | 12/1993 | Gueret | 222/494 |
| 5,271,513 | 12/1993 | Crosnier et al. . | |
| 5,325,999 | 7/1994 | Gueret | 222/553 |
| 5,379,919 | 1/1995 | Gueret | 222/105 |
| 5,413,250 | 5/1995 | Gueret | 222/494 |
| 5,505,341 | 4/1996 | Gueret | 222/494 |

FOREIGN PATENT DOCUMENTS

| | | | |
|---|---|---|---|
| 0073918 | 3/1983 | European Pat. Off. . | |
| 0282595 | 9/1988 | European Pat. Off. . | |
| 2565315 | 12/1985 | France . | |
| 591583 | 4/1959 | Italy | 222/553 |
| 2140509 | 11/1984 | United Kingdom . | |

*Primary Examiner*—Philippe Derakshani
*Attorney, Agent, or Firm*—Oliff & Berridge

[57] ABSTRACT

A dispenser of liquid or pasty product that can be used particularly in cosmetics includes a contractable reservoir connected by a first valve to a variable-volume chamber whose volume can vary under the action of a push-button. The variable-volume chamber is connected to an outlet by a second valve. The variable-volume chamber is formed by a body of the push-button and a stationary piston integral with the reservoir. The body of the push-button is formed of two parts, each equipped with an orifice and able to be twisted with respect to one another between a first open position in which the orifices of the two parts of the push-button face one another and fluidly communicate and a second closed position in which the orifices do not face one another so that product contained in the variable-volume chamber is prevented from reaching the second valve, thus immobilizing the push-button.

14 Claims, 3 Drawing Sheets

DISPENSER OF LIQUID OR PASTY PRODUCT WHICH CAN BE USED ESPECIALLY IN COSMETICS

BACKGROUND OF THE INVENTION

The subject of the present invention is a dispenser of liquid or pasty product that can be used especially in cosmetics.

Dispensers are already known that comprise a reservoir containing liquid or pasty product to be dispensed and a variable-volume chamber formed, for example, by a cylinder and a piston. The reservoir is connected by a first valve to the variable-volume chamber, which opens to the outside of the dispenser through a second valve. By causing the volume of the variable-volume chamber to vary, with the aid of a push-button, a pumping action is exerted causing the liquid or pasty product to pass from the reservoir into the variable-volume chamber and then to the outside of the dispenser.

Such known devices have the drawback that if, for any reason, an excess pressure is produced in the receptacle, the liquid or pasty product flows out of the dispenser, opening the two valves it encounters on its way. This adversely affects the seal of the device.

In addition to this, when such known devices are used with a rigid non-contractable reservoir, it is necessary to leave an opening for the passage of air, which has to progressively take the place of the product extracted from the receptacle by the dispenser.

This opening is also a source of leakage for the device.

SUMMARY OF THE INVENTION

The present invention aims, using simple and effective means, to overcome drawbacks such as those mentioned above by immobilizing the push-button that causes the product to be expelled.

An object of the present invention is to provide a dispenser of liquid or pasty product that can be used particularly in cosmetics, of the type including a contractable reservoir for the product to be dispensed. This reservoir is connected by a first valve to a variable-volume chamber whose volume can vary under the action of a push-button. The variable-volume chamber is connected to the outside by a second valve. A body of the push-button forms, with a stationary piston integral with the reservoir, the variable-volume chamber. The body of the push-button is formed of two concentric parts, each equipped with an orifice and able to be twisted with respect to one another between a first open position in which the orifices of the two parts of the push-button face one another and are in fluid communication therewith and a second closed position in which the orifices do not face one another so that the product contained in the variable-volume chamber is prevented from exiting through the second, external valve, thus immobilizing the push-button.

BRIEF DESCRIPTION OF THE DRAWINGS

For a better understanding of the invention, embodiments provided as non-limiting examples thereof will be described with reference to the attached drawings, wherein.

DETAILED DESCRIPTION OF PREFERRED EMBODIMENTS

In a preferred embodiment of the invention, limit stops are provided on the two parts of the push-button in order to limit relative rotation of the two parts between the positions in which a duct opening to the outside valve is open or closed.

It is also advantageous to provide externally-visible identification means for identifying the open and closed positions.

In a preferred embodiment of the invention, the communicating orifices of the two parts of the push-button are situated close to a point where the variable-volume chamber communicates with the second valve that opens to the outside.

In this preferred embodiment of the invention, the variable-volume chamber is formed by a stationary piston equipped with the first valve. A mobile cylinder incorporated into the lower part of the push-button slides on the piston and is pushed back by a spring arranged around the mobile cylinder and the stationary piston in a cavity formed at the upper part of the reservoir.

In an alternative embodiment, the spring is obtained directly by molding plastic at the same time as molding of the lower part of the push-button. In such a case, the spring is integral with the lower part.

The valve of the piston may be formed by two lips that spontaneously press together or by a shutter pushed back elastically so that it engages in an orifice in the piston.

Figure 1:
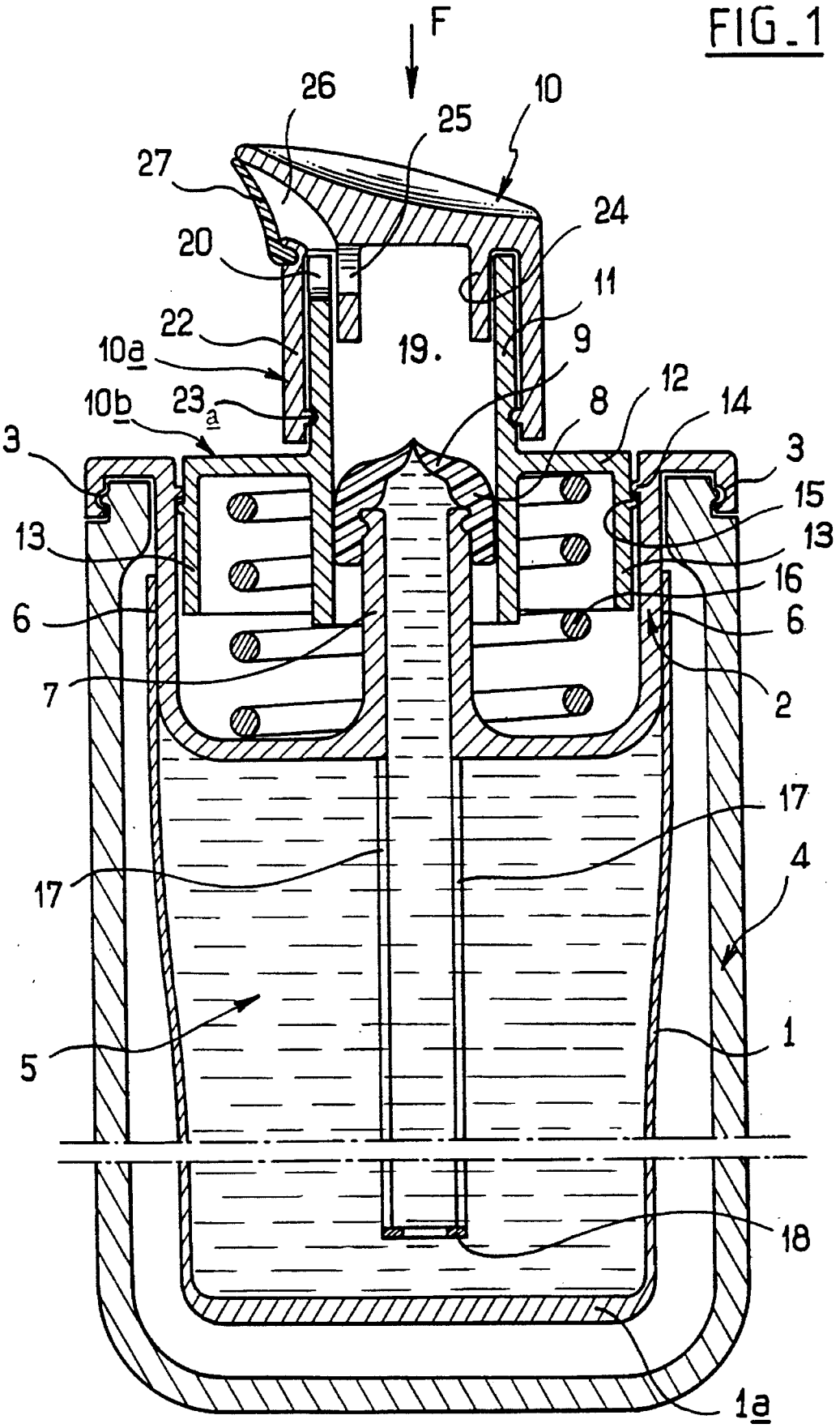
FIG. 1 is a cross-sectional view in longitudinal section of a first embodiment of the invention.

FIG. 1 shows a flexible reservoir 1 equipped with a stopper 2, the periphery 3 of which is snap-fastened over an upper part of a rigid receptacle 4 that surrounds the flexible reservoir 1.

The top part of the flexible reservoir 1 is welded or bonded at 6 to the external periphery of the stopper 2. After having been filled via its lower end with product 5 to be dispensed, the flexible reservoir 1 is welded at 1*a*.

The reservoir 1 has the advantage of being able to deform as product contained therein is dispensed, so that it is not necessary to provide an orifice for venting to atmosphere.

The stopper 2 axially includes a tube 7 equipped at its upper part with a piston 8 having a central orifice forming a first valve 9 that is closed in the state of rest.

A push-button 10 includes a lower part 10*b* formed by a cylinder 11 equipped with a flange 12 and with a skirt 13, the periphery of which slides inside an annular recess delimited by an internal wall of the stopper 2.

Two annular protuberances 14 and 15, one on the internal wall of stopper 2 and the other on the external periphery of skirt 13 of the push-button, limit the upward travel of the push-button under the action of a spring 16 housed in the annular space of stopper 2.

Upon assembly, protuberance 15 can easily be engaged under protuberance 14 because of the elasticity of the plastic from which the various pieces of the dispenser are made.

Stopper 2 is extended at its lower part along the axis of the tube 2 by several strips 17 joined together at their lower ends by a pierced roundel 18.

The purpose of strips 17 is to restrain the flexible reservoir 1 as it contracts from progressive dispensing of the product 5, preventing the formation of pockets where some of product 5 that could not be drawn up into the variable-volume chamber 19 situated inside push-button 10 might remain.

In other words, the presence of strips 17 ensures that, regardless of how full reservoir 1 might be, there is always an axial duct through which product 5 can flow as far as the variable-volume chamber 19.

The upper edge of the cylindrical part 11 of the push-button 10 includes a lateral orifice 20.

An upper part 10*a* of the push-button 10 includes a first external cylindrical skirt 22, a circular rib 23*a* that snap-fastens into a corresponding slot 23*b* in the cylindrical wall 11 of lower part 10*b* of push-button 10.

Upper part 10*a* of the push-button 10 also has a second, internal, cylindrical skirt 24 situated on the other side of the cylindrical wall 11.

Skirt 24 includes an orifice 25 which, as is represented in FIG. 1, may be brought into coincidence with orifice 20 in cylindrical wall 11, by twisting upper part 10*a* of the push-button with respect to its lower part 10*b*.

In this position, orifices 20 and 25 communicate with a duct 26 that leads to second valve 27 opening to the outside of the dispenser.

Figure 2:
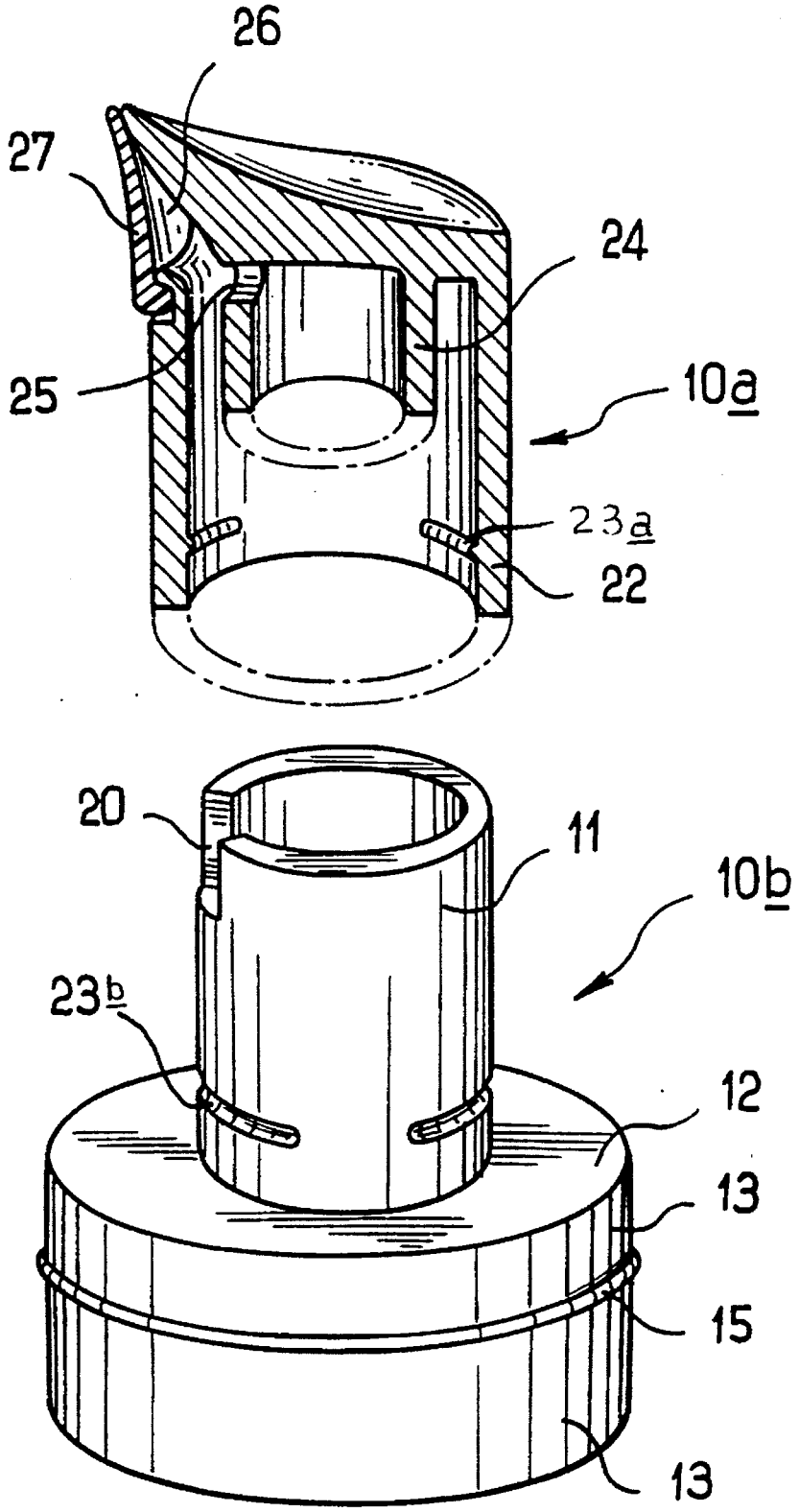
FIG. 2 is a perspective view with a partial cross-section representing the two parts of a push-button that form the variable-volume chamber of the embodiment of FIG. 1.

Represented in FIG. 2 is a perspective view of upper part 10*a* (partially cut away) and of lower part 10*b* of push-button 10.

It is again possible in this figure to see slot 23*b* in which the corresponding protuberance made on the internal surface of the skirt 22 of the upper part 10*a* of the push-button is engaged. This arrangement makes it possible to hold the part 10*a* on the part 10*b* while allowing part 10*b* to be twisted about its vertical axis.

Limit stops make it possible to limit the angle through which upper part 10*a* can be twisted with respect to the lower part 10*b* of the push-button so that in one position orifices 20 and 25 are in register and in the other position they are not.

According to a preferred embodiment, skirt 13 of lower part 10*b* exhibits, as may be seen in FIG. 2, a non-circular contour such as an oval contour corresponding to the overall shape of rigid receptacle 4.

This oval shape has the advantage of preventing lower part 10*b* of push-button 10 from being dragged along in rotation when upper part 10*a* is moved, allowing easy passage from the position in which the orifices 20 and 25 are in register to the position where they are not, and vice versa.

In order to extract product 5 from the dispenser, all that is required is to twist upper part 10*a* of push-button 10 to bring it into the position in which orifices 20 and 25 are facing one another, then to press push-button 10 in the direction of arrow F of FIG. 1 in order to reduce the volume of variable-volume chamber 19, thereby compressing spring 16.

By releasing the force on the push-button, spring 16 pushes the latter back upwards, thereby creating a depression inside chamber 19 that draws product 5 from the reservoir 1 into chamber 19.

When chamber 19 is initially empty, a few successive pushes on the push-button F are enough to fill chamber 19 and duct 26 with product 5. This is then expelled out of an outlet of the dispenser, pushing back second valve 27.

When the dispenser has already been used, all that is required is to press push-button 10 for the product that is in duct 26 and chamber 19 to be expelled to the outlet through the valve 27, while an overpressure prevailing inside chamber 19 keeps the first valve 9 communicating with reservoir 1 closed.

When upper part 10*a* of the push-button is twisted so that orifices 20 and 25 are no longer in fluid communication and so that orifice 20 is closed off by inside skirt 24, the product that occupies variable-volume chamber 19 can no longer escape from the latter, thereby making it impossible for push-button 10 to travel downwards.

Thus, product 5 that is in duct 26 between valve 27 and the skirt 24 runs no risk of spreading to the outside of the dispenser.

Another result is that there is no risk of skirt 22 becoming detached from cylinder 11 in the event of push-button 10 being pressed accidentally, because slot 23*b* is isolated from duct 26. In other words, the region serving to hold the twistable part of the push-button on the other part acting as a support is isolated from the product inside the part acting as a support when orifices 20 and 25 are no longer in communication.

Figure 3:
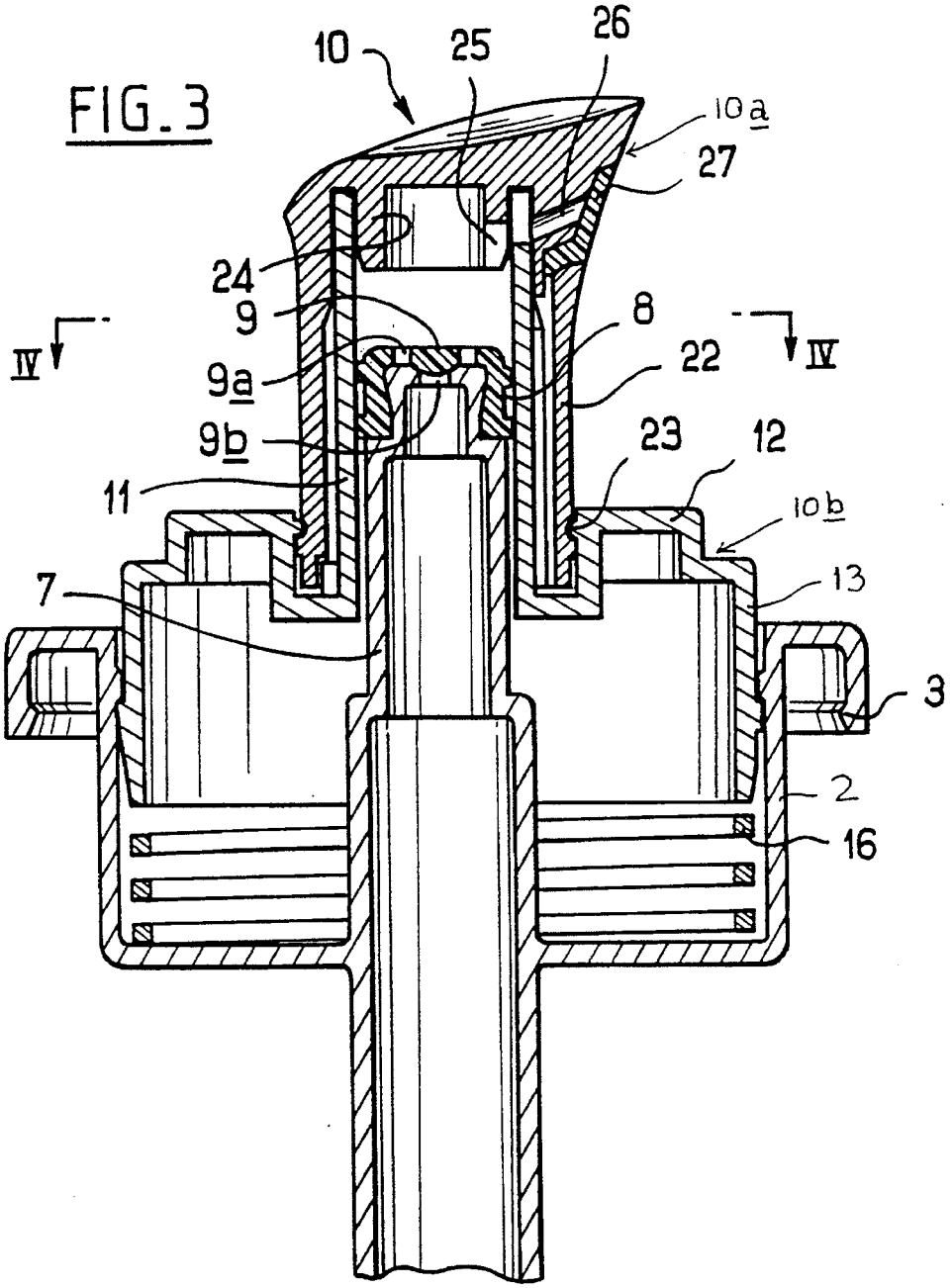
FIG. 3 is a cross-sectional view of a second embodiment of the invention.
Figure 4:
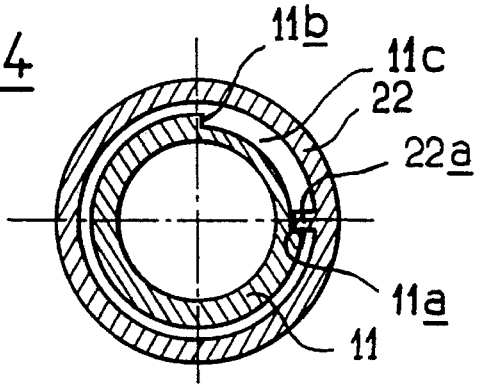
FIG. 4 is a cross-sectional view along lines IV—IV of FIG. 3.

FIGS. 3 and 4 represent a second embodiment of the invention, in which stopper 2 placed on the upper part of the receptacle, and push-button 10 is formed of a lower piece 10*b* formed by a cylinder 11 equipped with a flange 12 bearing a skirt 13.

In this embodiment, spring 16, which pushes the push-button back upwards, forms a single piece with the skirt 13, formed integrally when the plastic was molded.

In the embodiment of FIG. 3, the valve of stationary piston 8 is formed of a stub 9 surrounded on its periphery by orifices 9*a* to allow the product contained in the reservoir to pass. The stub 9 presses elastically against orifice 9*b* made in the top part of tube 7 that is integral with the stopper 2. When, after having been compressed downwards, push-button 10 is released, vacuum created in chamber 19 causes stub 9 to lift, which allows the product contained in the reservoir to flow out through orifices 9*b* and 9*a* and reach chamber 19, from where it is expelled when push-button 10 is depressed again, flowing out through ducts 25 and 26 as was previously described for the first embodiment.

FIG. 4 represents diagrammatically how tubular internal part 11 of the push-button 10, over approximately one quarter of its periphery, has two limit stops 11*a* and 11*b* delimiting a recess 11*c*.

FIG. 4 also shows how upper part 10*a* of the push-button, inside its cylindrical wall 22, has a rib 22*a* that interacts with limit stops 11*a* and 11*b* to limit the rotation of upper part 10*a* of the push-button between a position represented in FIG. 3 in which orifices 20, 25 and 26 are in register and another position (not shown), in which the upper part of cylinder 11 has no opening 20 and therefore seals off the passage between openings 25 and 26. This avoids any flow of the product contained in the volume 19 towards the outside, even if push-button 10 is depressed.

As may be seen, the dispenser according to the invention has a particularly simple and economical construction while offering complete safety against the undesired flow of product to the outside.

The overall structure of the dispenser according to the invention allows the various pieces, which are of a simple shape and few in number, to be produced easily by molding from plastic.

Although the invention has been described in connection with particular embodiments, it is evident that the invention is not limited thereto. Various changes and modifications can be made without departing from the framework or spirit embodied by the appended claims.

In particular, flexible reservoir 1 may be replaced by a reservoir with a follower piston, the working volume of which decreases progressively as the product is used up.

What is claimed is:

1. A dispenser of liquid or pasty product, comprising:

a contractable reservoir from which the product may be dispensed; and a variable-volume chamber connected to said reservoir by a first valve and connected to an outlet of the dispenser by a second valve, said chamber having a volume that can vary under action of a push-button, said push-button and a stationary piston integral with said reservoir forming said variable-volume chamber, wherein said push-button comprises a body formed of a first part and a second part, said first part having a first orifice and said second part having a second orifice, said first part and said second part being capable of twisting relative to one another between an open position in which said first orifice and said second orifice face one another and are in fluid communication therewith to allow dispensing of the product and a closed position in which said first orifice and said second orifice do not face one another and product contained in said variable-volume chamber is prevented from reaching said second valve, thereby immobilizing said push-button.

2. A dispenser according to claim 1, wherein said first and second orifices are situated close to said second valve such that the open and closed positions can be visually identified.

3. A dispenser according to claim 1, wherein said variable-volume chamber is formed by said stationary piston equipped with said first valve and a mobile cylinder, slidable about said piston and incorporated into the second part of said push-button, a spring being arranged around said mobile cylinder and said stationary piston in a cavity formed at one end of said reservoir for biasing said push-button outwards.

4. A dispenser according to claim 1, wherein said push-button is biased outwards by a spring molded integrally as a single piece with said second part of said push-button.

5. A dispenser according to claim 3, wherein said second part of said push-button includes a flange equipped on its periphery with a skirt that slides against an internal peripheral surface of an annular cavity of a stopper that seals off an end of a dispenser receptacle.

6. A dispenser according to claim 1, wherein said reservoir is a flexible reservoir, the volume of which reduces as the product is dispensed.

7. A dispenser according to claim 1, wherein said reservoir includes a part equipped with a follower piston that moves gradually in order to reduce the volume of said reservoir as the product contained in said reservoir is dispensed.

8. A dispenser according to claim 1, wherein said first and second valves are located such that said open and closed positions can be visually identified.

9. A dispenser according to claim 1, wherein said push-button is located on a top end of a reservoir and said first part is an upper part and said second part is a lower part.

10. A dispenser according to claim 5, wherein said second part is non-circular and corresponds to an overall shape of said receptacle.

11. A dispenser according to claim 10, wherein said second part is oval shaped.

12. A dispenser according to claim 5, wherein said stopper includes one or more strips extending within said reservoir to restrain reservoir contraction upon dispensing of the product.

13. A dispenser according to claim 5, wherein travel of said push-button is limited by protuberances located on an interior wall of said stopper and an external periphery of said skirt.

14. A dispenser according to claim 1, wherein a cosmetic is contained in said reservoir.

* * * * *